US007733023B2

(12) United States Patent
Longoni et al.

(10) Patent No.: US 7,733,023 B2
(45) Date of Patent: Jun. 8, 2010

(54) PROCESS FOR THE PRODUCTION OF PLASMA DISPLAYS WITH DISTRIBUTED GETTER MATERIAL AND DISPLAYS THUS OBTAINED

(75) Inventors: Giorgio Longoni, Monza MI (IT); Corrado Carretti, Milan MI (IT); Stefano Tominetti, Milan MI (IT)

(73) Assignee: Saes Getters S.p.A., Lainate MI (IT)

( * ) Notice: Subject to any disclaimer, the term of this patent is extended or adjusted under 35 U.S.C. 154(b) by 225 days.

(21) Appl. No.: 11/570,502

(22) PCT Filed: Jul. 6, 2005

(86) PCT No.: PCT/IT2005/000385

§ 371 (c)(1),
(2), (4) Date: Dec. 13, 2006

(87) PCT Pub. No.: WO2006/008770

PCT Pub. Date: Jan. 26, 2006

(65) Prior Publication Data

US 2008/0020668 A1 Jan. 24, 2008

(30) Foreign Application Priority Data

Jul. 19, 2004 (IT) ..... MI2004A1443

(51) Int. Cl.
*H01J 63/04* (2006.01)
*H01J 1/62* (2006.01)
*H01J 9/00* (2006.01)

(52) U.S. Cl. ..... 313/582; 313/581; 313/483; 313/584; 313/585; 445/24; 445/25

(58) Field of Classification Search ..... None
See application file for complete search history.

(56) References Cited

U.S. PATENT DOCUMENTS 3,203,901 A 8/1965 Della Porta (Continued)

FOREIGN PATENT DOCUMENTS

EP 0 911 856 A2 4/1999

(Continued)

OTHER PUBLICATIONS

Henri, Doyeux, "Invited Paper: Color Plasma Displays: Status of Cell Structure Designs", SID Digest, pp. 212-215, (2000).

(Continued)

*Primary Examiner*—Nimeshkumar D Patel
*Assistant Examiner*—Natalie K Walford
(74) *Attorney, Agent, or Firm*—Panitch Schwarze Belisario & Nadel LLP

(57) ABSTRACT

A manufacturing process for the production of plasma display panels is provided which allows obtaining in a simple way displays in which getter materials deposits are present in contact with the atmosphere present in channels or cells of the display. The process includes a step of forming the getter material deposits on a free surface of the magnesium oxide layer at positions essentially corresponding to contact areas between the front glass panel and the barriers on the rear glass panel of the display panel.

17 Claims, 7 Drawing Sheets

U.S. PATENT DOCUMENTS

| | | | | |
|---|---|---|---|---|
| 4,312,669 | A | 1/1982 | Boffito et al. | |
| 5,882,727 | A | 3/1999 | Corazza et al. | |
| 5,961,750 | A | 10/1999 | Boffito et al. | |
| 5,984,747 | A * | 11/1999 | Bhagavatula et al. | 445/24 |
| 6,472,819 | B2 | 10/2002 | Carretti et al. | |
| 6,483,238 | B1 | 11/2002 | Baret et al. | |
| 6,603,260 | B1 | 8/2003 | Kim et al. | |
| 2002/0008469 | A1 * | 1/2002 | Carretti et al. | 313/562 |
| 2003/0071579 | A1 | 4/2003 | Ryu et al. | |
| 2003/0151362 | A1 * | 8/2003 | Alberto et al. | 313/586 |
| 2005/0099124 | A1 * | 5/2005 | Chen et al. | 313/582 |

FOREIGN PATENT DOCUMENTS

| | | | |
|---|---|---|---|
| EP | 1518599 | A2 | 3/2005 |
| JP | 61240528 | | 10/1986 |
| JP | 03254042 | | 11/1991 |
| JP | 2002-075170 | | 3/2002 |
| JP | 2002-75170 | A | 3/2002 |
| KR | 2001049126 | A | 6/2001 |
| KR | 2001-0091313 | A | 10/2001 |
| KR | 2001-0104469 | A | 11/2001 |
| KR | 10-0366095 | B1 | 12/2001 |

OTHER PUBLICATIONS

Jeong-Eun Heo et al., "Relationships Between Impurity Gas Luminance/Discharge Characteristics of AC PDP", Journal of Information Displays, vol. 2, No. 4, pp. 29-33, (2001).

W.E. Ahearn et al., "Effect of Reactive Gas Dopants on the MgO Surface in AC Plasma Display Panels", IBM J. Res Develoop., vol. 22, No. 6, pp. 622-625, (1978).

* cited by examiner

PRIOR ART

PROCESS FOR THE PRODUCTION OF PLASMA DISPLAYS WITH DISTRIBUTED GETTER MATERIAL AND DISPLAYS THUS OBTAINED

CROSS-REFERENCE TO RELATED APPLICATIONS

This application is a section 371 of International Application No. PCT/IT2005/000385, filed on Jul. 6, 2005, which was published in the English language on Jan. 26, 2006, under International Publication No. WO 2006/008770 and the disclosure of which is incorporated herein by reference.

BACKGROUND OF THE INVENTION

The present invention relates to a process for manufacturing plasma display panels with distributed getter material; the invention relates also to the displays obtained according to the process of the invention.

Plasma display panels are known under the abbreviation PDP, which will be used in the following.

A PDP is composed of two planar glass parts, a front one and a rear one, sealed at their perimeter by a low-melting point glass paste. In this way, between the two glass parts a closed space is formed, filled with a rare gas mixture and comprising functional components, as specified in the following; generally the rare gas mixture is composed of neon and xenon, with the latter being present in a quantity between about 4 and 15%.

The working principle of a PDP is based on the conversion into visible light, by the so-called phosphors, of ultraviolet radiations when an electric discharge is generated in the rare gas mixture. In order to form an image, a plurality of light sources of small dimensions is necessary, and thus a plurality of electrodes which generate localized discharges. Every light source formed in this way is defined in the field "pixel."

FIGS. 1 and 2 show in cross-section, respectively, a part of a known PDP and of its front glass panel only (the relative dimensions are not in scale); in particular, the two views are taken along two mutually orthogonal sections. On the front glass panel, FP, is present a series of pairs of parallel electrodes, E1 and E2, defined as supporting electrodes and as scanning electrodes respectively, being protected by a dielectric layer, DF, which in turn is covered with a layer, M, of magnesium oxide (MgO). This layer, M, has the double function of protecting the dielectric layer from the ionic bombardment due to the plasma triggered by the discharge, and of supplying secondary electrons for maintaining the discharge. On the rear glass panel, RP, a series of so-called address electrodes, AE, is present (having a direction orthogonal to the electrodes E1 and E2), covered by a dielectric layer, DR. A series of barriers R (known in the field as "ribs") that are mutually parallel to each other and parallel to the electrodes AE, is constructed onto this latter layer. Since the internal pressure of the display is lower than atmospheric pressure, the upper portion of the ribs is in contact with layer M, thus dividing the inner space of the display into parallel channels, indicated as C in the drawing, having a width between 0.1 and 0.3 mm. Each one of these channels is covered internally with phosphors. Particularly, in the channels there are present in an alternating way phosphors, able to convert ultraviolet light respectively into red (phosphors PR), green (PG) and blue (PB) visible light. By applying a potential difference to a given electrode pair E1 and E2 and to an electrode AE, an electric discharge is generated in the zone of a pixel, that causes the light emission indicated by the arrows in FIG. 1.

The area of the front glass panel, corresponding to the zone of the channels, is the part on which the image is formed.

Recently, interfering effects between the electric discharges at contiguous pixels in one channel have been noticed (a phenomenon known as "cross-talking"), which cause a deterioration of the image quality, especially in the case of high-definition displays (i.e. having pixels of small dimensions). In order to reduce the phenomenon, more complex configurations of the ribs have been proposed, such as shown in the FIGS. 3 to 5. In the case of FIG. 3 the channels are divided transversally by barriers of a height that is lower than that of the ribs; in the case of FIG. 4 the ribs define pixels of essentially hexagonal geometry, separated by necks with a reduced cross section; finally, FIG. 5 shows a structure in which there are transversal barriers of the same height as the ribs, so that the inner space of the display results divided in ordered rows of completely closed cells (each one corresponding to a pixel).

The manufacturing processes of PDPs are essentially of two types, i.e. the so-called "pumping tubulation" processes, currently used, or the "chamber processes", under investigation. In a process of the pumping tabulation type, in one of the two glass panels forming the display (usually the rear panel) an opening is formed, connected to a glass tubulation. After the perimetral sealing of the perimeter of the two glass panels, first the evacuation of the inner space is carried out by pumping through the tubulation, and subsequently the inner space is filled with the desired rare gas mixture; finally, the tubulation is closed by compression under heat, thus sealing the inner space of the display. In contrast, in a chamber process the two finished glass panels are introduced into a chamber filled with an atmosphere having a composition and pressure corresponding to that of the rare gas mixture required for operating the PDP, and are sealed to each other in this chamber, to enclose the appropriate atmosphere. Consequently, in the case of the pumping tabulation processes the filling of the display with the gas mixture follows the sealing of the two glass panels, while in the case of the chamber processes the two steps are simultaneous. It must be noted that while generally the choice of either process is free, in the particular case of displays with an internal structure with closed cells, as that shown in FIG. 5, it is necessary to resort to the chamber process, because after the sealing of the two glass panels it would no longer be possible to evacuate the cells or to fill them with the rare gas mixture via the tubulation.

For proper operation of these devices it is necessary that the chemical composition of the gaseous mixture in which the plasma is formed remains constant: in fact, the presence in the gaseous mixture of traces of atmospheric gases, such as nitrogen, oxygen, water or carbon oxides, has the effect of varying the operating electrical parameters of the PDP, as discussed in the articles "Effect of reactive gas dopants on the MgO surface in AC plasma display panels," by W. E. Ahearn et al., published in *IBM J. Res. Develop.*, Vol. 22, No. 6, p. 622 (1978); "Color plasma displays: status of cell structure designs" by H. Doyeux, published in *SID* 00 *Digest*, p. 212; and "Relationships between impurity gas and luminance/discharge characteristics of AC PDP" by J.-E. Heo et al., published in "*Journal of Information Display*", Vol. 2, No. 4, p. 29 (2001). In particular, among PDP manufacturers, water is the impurity regarded as the most dangerous one. These impurities can remain in the panel following the manufacturing process, or they can accumulate at the inside with time, as a consequence of outgassing of the component materials themselves. The first contribution is particularly important in the case of the pumping tabulation processes, in which the limiting factor for the evacuation speed of the inner space is the low gas conductance in the channels, which causes the problem that the removal of the impurities cannot be completed within the evacuation times (some hours) compatible with the industrial manufacturing processes of PDPs. The problem is even worse in the case of PDPs with internal structures like those shown in FIGS. 3 and 4 (while as already stated, displays with a structure of type shown in FIG. 5 cannot be produced in this way). The contribution from the outgassing during the service life is, however, the same in PDPs produced by both methods.

In order to solve these problems it has been proposed to introduce into the PDPs in various ways getter materials, i.e. materials capable of reacting with impurities and to chemically fix them, thus removing them definitely from the inner space of these displays.

U.S. Pat. No. 6,472,819, U.S. patent application publication 2003/0071579 A1, and Korean published patent application KR 2001-104469 A1 disclose PDPs in which getter material deposits are present in the peripheral zone, within the sealing zone between the front and rear glass panels and the image-forming zone. The getter deposits according to these documents are efficient both in increasing the removal speed of the impurities during the manufacturing process of the display, and in removing the impurities generated by outgassing during the service life thereof. In spite of the advantages offered, the getter systems according to these documents do not yet yield totally satisfactory results. In fact, particularly during the service life of the display, the impurities need some time to reach the getter materials, during which inhomogeneity of gas composition across the PDP may arise, and consequently differences in luminosity or in image quality at different parts of the display.

To overcome the problem, some patent documents describe various configurations in which the getter material is distributed in the image forming area.

Korean Patent No. 366095 and Korean patent application publication KR 2001-049126 A1 describe PDPs in which linear getter material deposits, parallel to the electrodes (of the type $E_1$ and $E_2$ in FIG. 1), are present on the front glass panel, so that the getter deposits also form the so-called "black matrix" of the display (a dark element surrounding the pixels that increases the contrast of the display). However, in the structures described in these documents the getter deposits cover part of the surface dedicated to the light emission and thus an extremely precise control of dimensions and location of these deposits is required, with quite complex manufacturing processes. Moreover, at least in the case of Korean Patent 366095, the surface of the getter deposits forms an undercut with respect to the surface of the magnesium oxide layer, whereby every getter deposit provides for a possible communication passage for the gases between contiguous channels, with a possible increase of the cross-talking.

U.S. Pat. No. 6,483,238 B1 and Japanese patent application publication JP 2002-075170 A1 disclose PDPs in which the ribs are made from a porous material containing the getter material, while the Korean patent application publication KR 2001-091313 A1 discloses a PDP in which the ribs are made from getter material. These structures, however, show some constructive problems, in so far as the ribs are generally constructed by successive depositions of a suspension of particles of the desired material with the screen-printing technique, drying after every layer deposition, and final consolidation of the rib by thermal treatment. The use of a mixture of various materials, among them a getter, gives some problems, since the getter could be contaminated during the thermal treatments of drying and consolidation by the vapors of the solvent used for the deposition, thus inactivating the getter for the service life of the display. Conversely, the presence of getter particles could compromise the mutual adhesion of the particles of ceramic material of which the ribs are normally formed, thus reducing their mechanical resistance.

Finally, U.S. Pat. No. 6,603,260 B1 discloses a PDP in which a getter material is deposited on the upper surface of the ribs, in contact with the front glass panel. However, this solution also presents notable constructive difficulties. In fact, in order to deposit the getter selectively only on the upper surface of the ribs, extremely precise masking operations are necessary to avoid the material spreading along the lateral walls and occupying the zone designated for the phosphors (or covering them, in case these are already present).

BRIEF SUMMARY OF THE INVENTION

An object of the present invention is to overcome the shortcomings of the prior art, in particular to provide a simple manufacturing process for producing a plasma display panel containing a distributed getter.

This and other objects are achieved according to the present invention, with a manufacturing process for plasma display panels comprising the following steps: manufacturing a front glass panel of a plasma display panel provided with pairs of supporting electrodes and scanning electrodes, a layer of dielectric material for the protection of the electrodes and a layer of magnesium oxide which covers the layer of dielectric material; manufacturing a rear glass panel of a plasma display panel provided with barriers designed to define channels or cells in the finished display, address electrodes and phosphors; sealing along the outer perimeter of the front and rear glass panels, thus defining a closed space or a plurality of closed spaces inside the display; and filling the spaces with a rare gas mixture necessary for the operation of the display; characterized in that before the sealing step, on the free surface of the magnesium oxide layer, getter material deposits are formed at positions essentially corresponding to the contact areas between the front glass panel and the barriers on the rear glass panel.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

The FIGS. 1 to 5 have been described in the Background section above.

The process of the invention is different from the known processes only in that the manufacturing of the front glass panel comprises the steps of forming a number of getter deposits on the surface, that in the finished display is facing the inner space, at locations essentially corresponding to the contact areas with the upper portion of the ribs. The getter deposits may be formed either on the plane surface of the MgO layer (M in FIG. 1) or into recesses formed in this layer. The invention is applicable indifferently to either pumping tabulation or in chamber manufacturing processes of PDPs.

Figure 1:
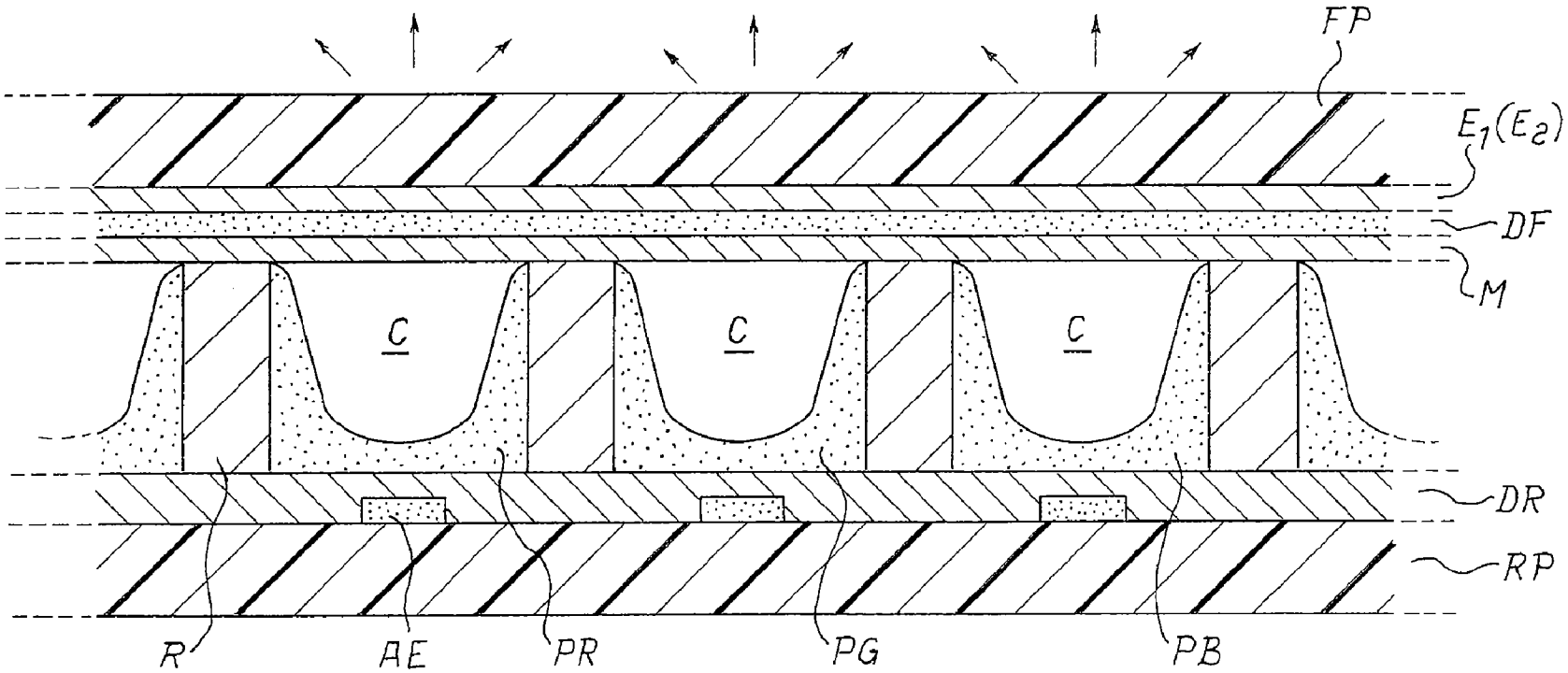
Fig.1 PRIOR ART
FIG. 1 is a cross sectional view of a prior art plasma display panel taken perpendicular to the channels.
Figure 2:
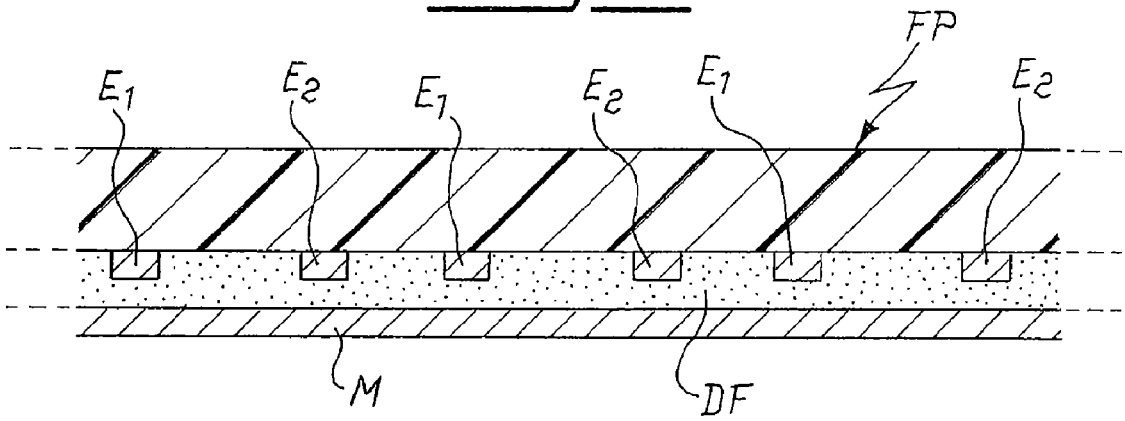
FIG. 2 is a partial view of a cross-section of only the front glass panel of a prior art plasma display panel, orthogonal to the view of FIG. 1.
Figure 3:
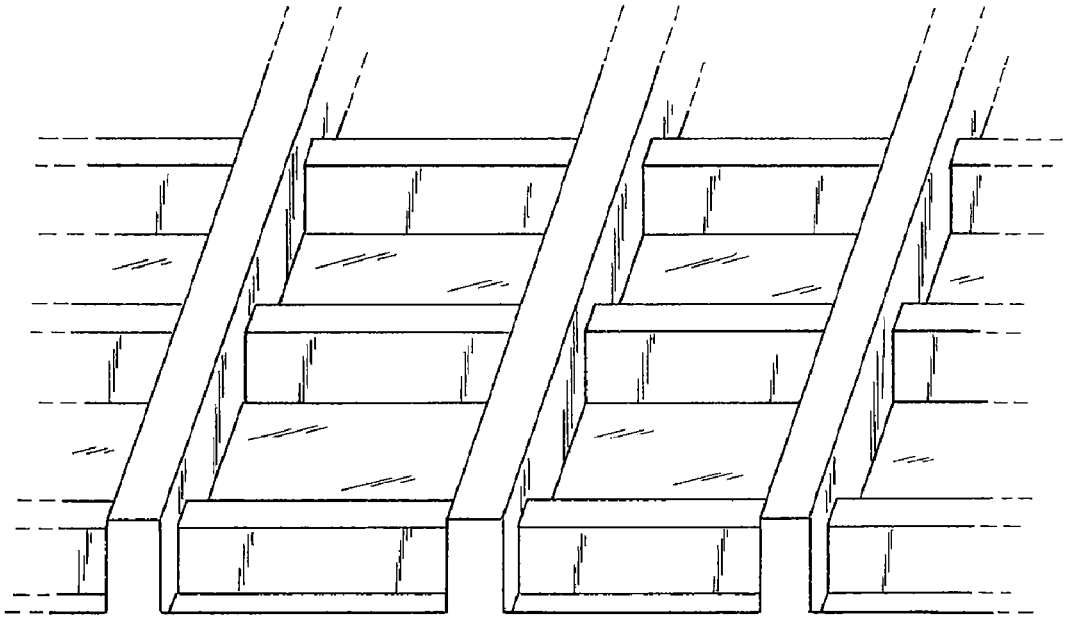
PRIOR ART Fig. 3
FIGS. 3 to 5 are perspective plan views of particular embodiments of the ribs that define the channels or cells of displays known in the art.
Figure 4:
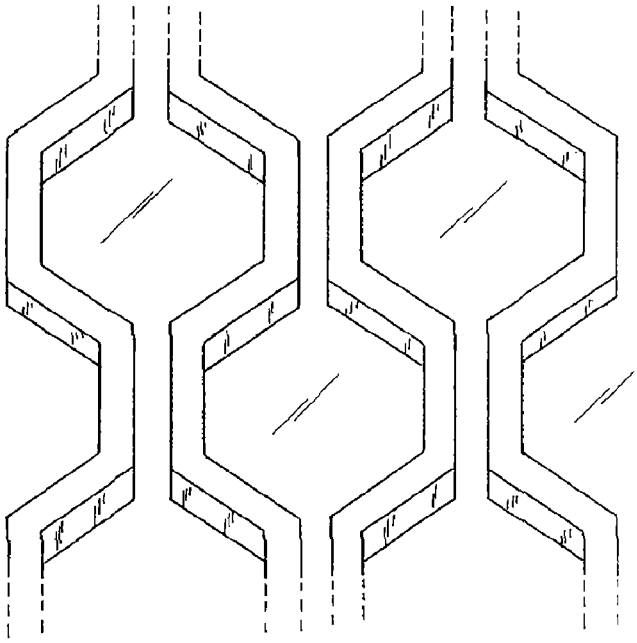
Fig. 4 PRIOR ART
Figure 5:
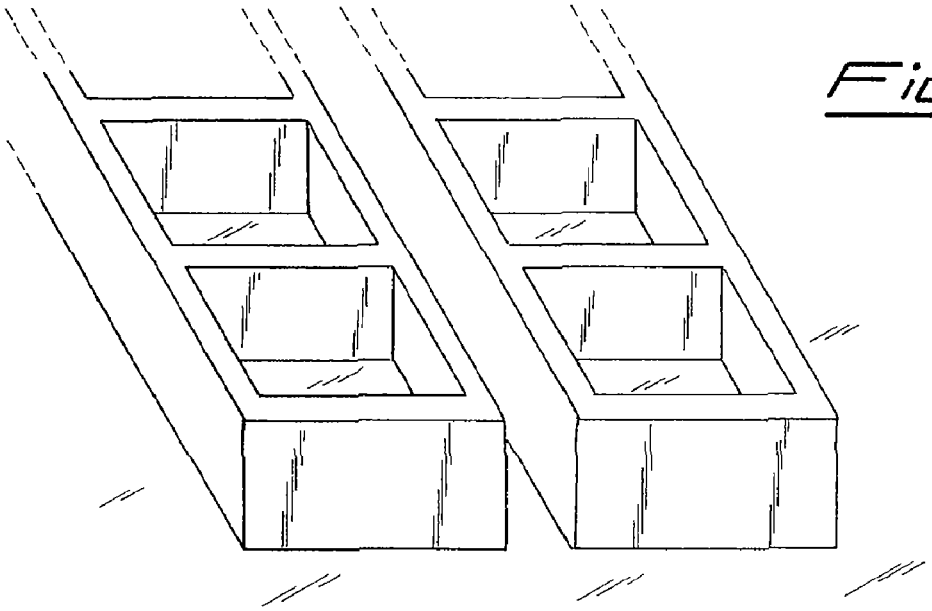
Fig. 5 PRIOR ART
Figure 6:
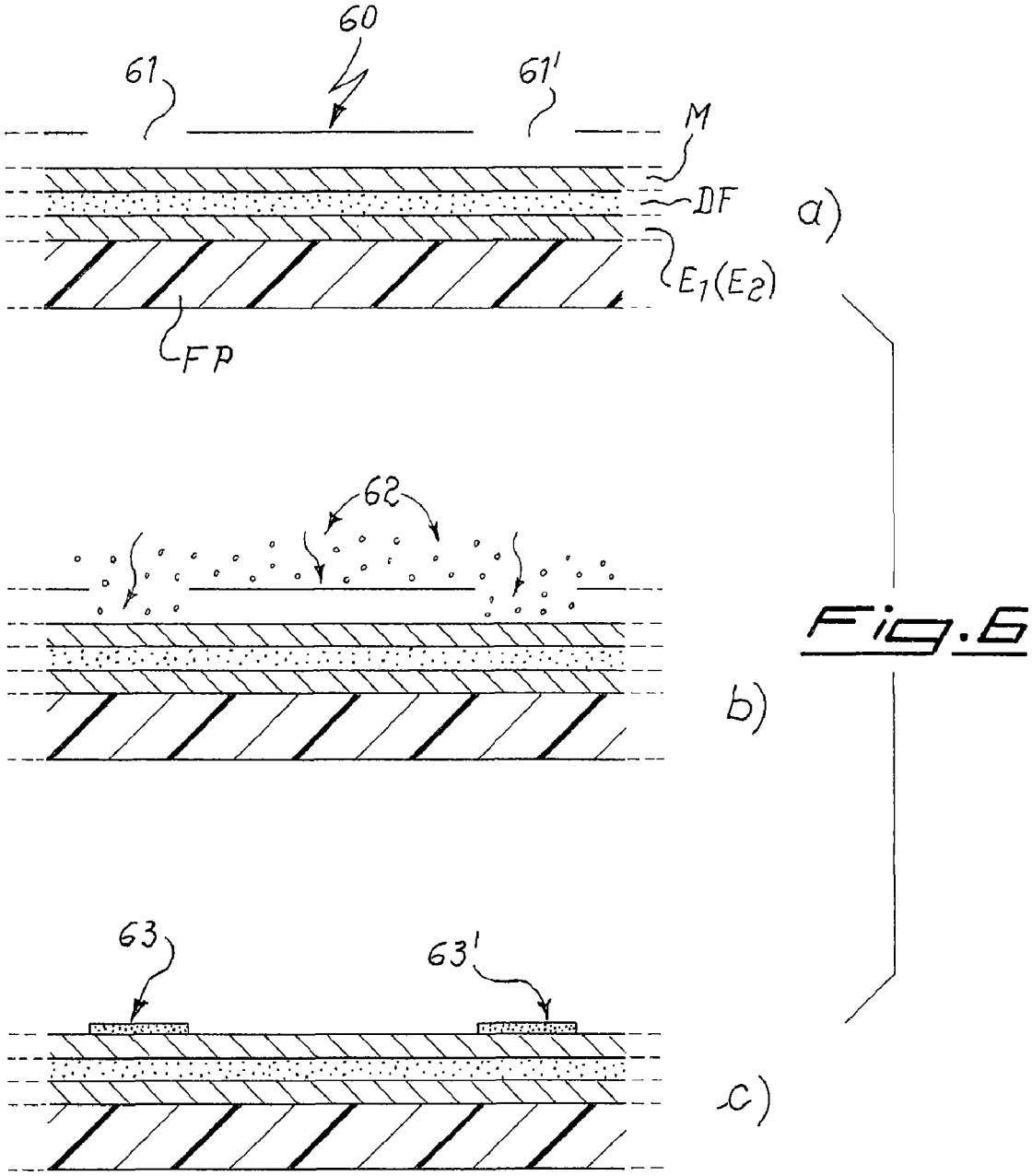
FIG. 6 is a series of views similar to that of FIG. 2, illustrating the main operational steps (a), (b) and (c) characterizing the process of the invention in a first embodiment thereof.

FIG. 6 shows the various steps of the operation characterizing the invention in a first embodiment (in this drawing, the front glass panel is shown upside down with respect to FIGS. 1-5). During step a, above the surface of the magnesium oxide layer onto which the getter deposits are to be formed, a mask 60 is aligned, provided with apertures 61, 61', . . . , that geometrically correspond to the zones where the front glass panel will contact the upper portion of the ribs in the finished display. For clarity of the drawing mask 60, it is shown spaced apart from the surface of layer M, but it could be in contact therewith. In step b, particles (generally referred to as element 62) of getter material are brought onto the upper surface of the mask 60 in various ways, according to the adopted deposition technique, and reach the free surface of the layer M only in the zones of the apertures 61, 61', . . . . Finally, in step c, the deposits 63, 63', . . . of getter material particles have been formed. These deposits may or may not require thermal treatments for consolidation, depending on the deposition process.

Figure 7:
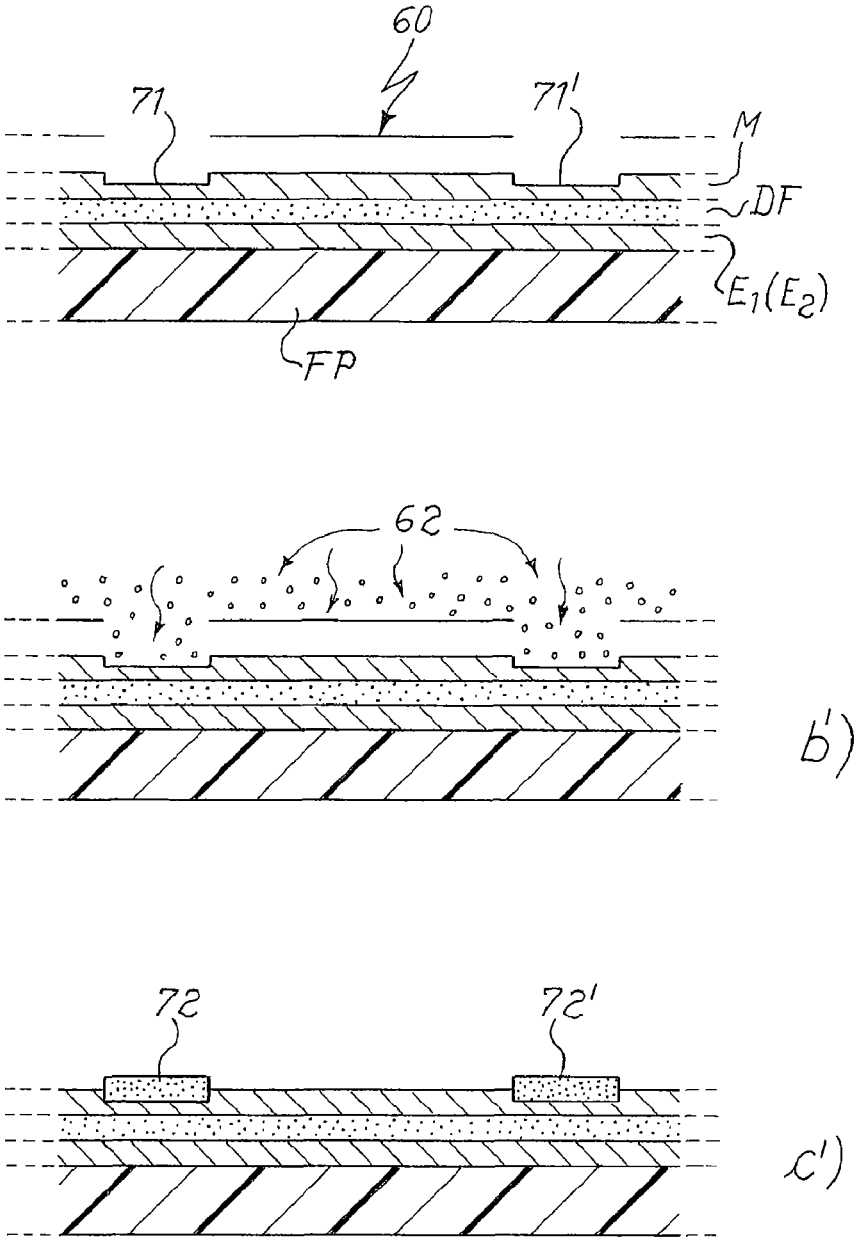
FIG. 7 is a series of views similar to FIG. 6, showing the main operational steps (a), (b) and (c) characterizing the process of the invention in an alternative embodiment thereof.

FIG. 7, similar to FIG. 6, shows the various steps of the additional operation characterizing the invention in an alternative embodiment. In this case the free surface of the MgO layer has recesses 71, 71', . . . corresponding to the apertures 61, 61', . . . of the mask 60. These recesses may be obtained either during the formation of layer M, or by selective removal of material from the layer M, for example by ion bombardment, using in this operation (not shown in the drawing) the same mask 60. The recesses 71, 71', . . . shown in the drawing extend only within layer M, but could also pass through it and reach the underlying layer DF. Step a' corresponds to step a of the first embodiment, with the only difference that in this case a higher precision in the alignment of the mask 60 with respect to the surface of the layer M is required. The following steps b' and c' are similar to the steps b and c of the first embodiment, resulting in the formation of the getter material deposits 72, 72', . . . . Preferably, step b' has a longer duration than step b, in order to allow the complete filling of the recesses 71, 71', . . . and the formation of deposits 72, 72', . . . of such a height to protrude from the free surface of the layer M (thus obtaining a similar result to the deposits 63, 63', . . . ). This has the effect of favoring the contact between the gases to be sorbed and the lateral surfaces of the deposits 72, 72', . . . in the finished display.

The material and the construction of mask 60, and the distance between the mask and layer M during the deposition of the getter material particles 62, depend on the adopted deposition technique, which itself can depend on the nature of the material to be deposited.

As stated in the Background, the main impurity to be sorbed is water, whereby it is possible to use a moisture sorbing material as getter. The preferred materials to this effect are the oxides of alkaline-earth metals, which react with water according to the reaction:

$$MO+H_2O \rightarrow M(OH)_2$$

where M can be calcium, strontium or barium; it is also possible to use mixtures of these oxides, possibly with addition of magnesium oxide.

For producing the deposits (63, 63', . . . ; 72, 72', . . . ) of these oxides it is possible to use various techniques, among which, for example, are screen-printing, sputtering, chemical vapor deposition (CVD), or electron beam evaporation.

The technique of screen-printing is well-known in the field of reproduction of patterns on textiles, ceramics or other materials, and is described in the case of the preparation of getter deposits, for example, in the U.S. Pat. No. 5,882,727, to which it is referred for details. In this case the mask 60 consists of a net with openings selectively blocked by a polymeric material, leaving clear the openings corresponding to the apertures 61, 61', . . . . Then, a suspension of the material particles to be deposited is prepared in a suitable suspension medium; the mask is preferably laid onto the layer M of the front glass panel; and the suspension is distributed onto the net and forced to pass to the underlying support, in correspondence with the apertures. In the specific case of the present invention the suspension medium obviously cannot be water-based (as common in other applications of the technique), because of the nature of the materials to be deposited, whereby organic solvents can be used, such as liquid hydrocarbons at room temperature. It is particularly easy to produce mixed deposits with this technique, starting from a mixture of different oxide particles.

The techniques of sputtering, CVD and electron beam evaporation, which are widely used in the microelectronics industry and are well known to the technicians of the field, do not require further illustration. In this case the mask 60 can be a discrete element, for example a metallic foil with holes corresponding to the apertures 61, 61', . . . ; or, as widely known in the field, it is possible to use a polymeric deposit formed onto layer M, in which the apertures are formed by sensitization with UV light and subsequent chemical attack to the sensitized zones. After the formation of deposits 63, 63', . . . or 72, 72', . . . , all polymeric material is removed using a chemical attack, different from the first one. In the case of sputtering, the deposition of one or more oxides can be obtained either starting directly from targets of oxides, or starting from metal targets by operating in the so-called "reactive sputtering" conditions, i.e. with a small percentage of oxygen in the reaction atmosphere. In the case of CVD, the substrate is held at a temperature sufficiently high to decompose the organic component carrying the interested metal and in an oxidizing atmosphere, so that the decomposition of the organic precursor and the formation of the oxide occur at the same time. In this case, it is particularly easy to form a mixed oxide, because it is sufficient to transport a mixture of vapors composed of precursors of the different metals onto the substrate (the layer M). Finally, in the case of electron beam evaporation, it is sufficient to subject to electron bombardment a material (or a mixture of materials) corresponding to the material intended for the deposit. This material (or mixture) can, for example, be contained in a crucible with the upper surface open, placed in the same chamber as the support on which the deposits are to be formed.

For the sorption of impurities different from water it is possible to form deposits of non-evaporable getter metals or alloys. These materials (known as NEG) are widely employed for the sorption of reactive gases in all applications where it is required to maintain vacuum or the purity of inert gasses. Examples of these materials are the metals titanium and zirconium or their alloys with one or more elements selected from the transition metals and aluminum. In particular the alloys Zr—Al can be mentioned, described in U.S. Pat. No. 3,203,901, and in particular the alloy with weight percent composition Zr 84%-Al 16%, manufactured and sold by SAES Getters S.p.A. under the trademark St 101; the alloys Zr—V—Fe described in U.S. Pat. No. 4,312,669, and in particular the alloy with weight percent composition Zr 70%-V 24.6%-Fe 5.4%, manufactured and sold by SAES Getters S.p.A. under the trademark St 707; and the ternary alloys Zr—Co-A (where A indicates an element selected from yttrium, lanthanum, rare earths or mixtures thereof) described in U.S. Pat. No. 5,961,750, and in particular the alloy with weight percent composition Zr 80.8%-Co 14.2%-A 5%, manufactured and sold by SAES Getters S.p.A. under the trademark St 787. Deposits of these materials are preferably produced by sputtering or electron beam evaporation.

Figure 8:
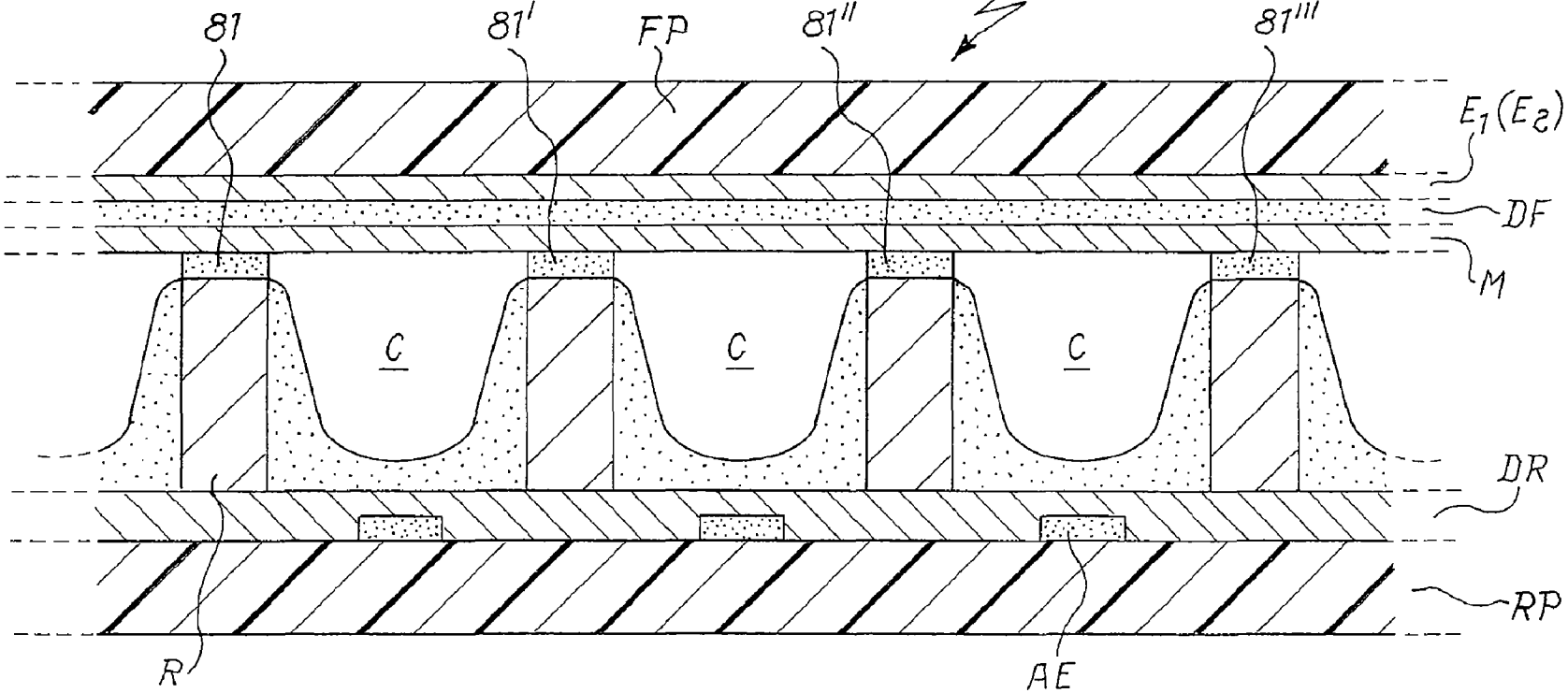
FIG. 8 is a cross sectional view similar to FIG. 1, illustrating a plasma display panel of the invention in its most general embodiment.
Figure 9:
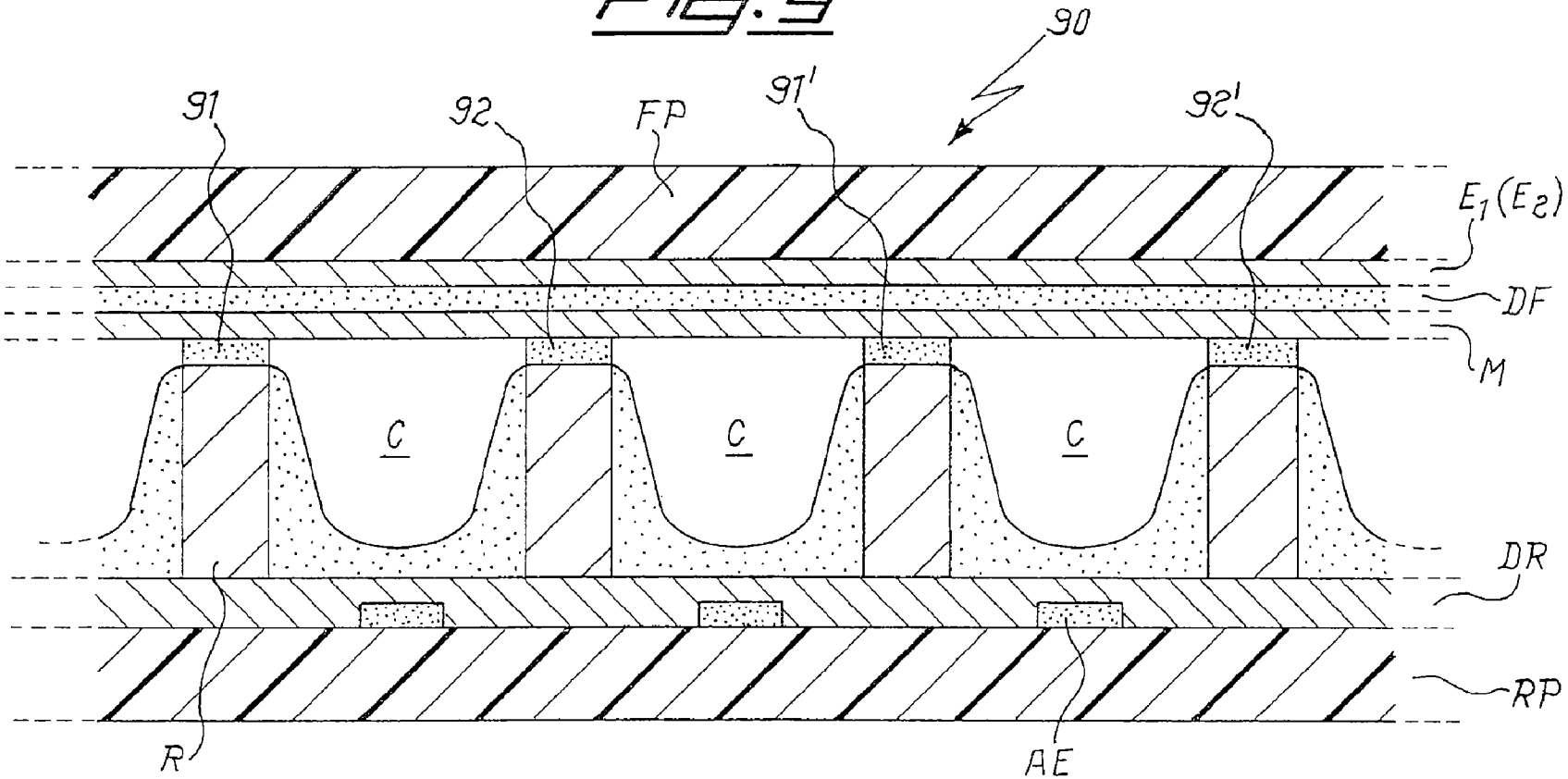
FIG. 9 is a view similar to that of FIG. 8, illustrating a plasma display panel according to an alternative embodiment.

FIG. 8 shows a cross sectional view, taken perpendicular to the direction of the channels, of a plasma display panel 80 according the invention, in its most general embodiment, in which deposits of getter material are indicated by 81, 81', . . . , independently of the nature of the latter The NEG materials operate better at relatively high temperatures, for example, above 300° C., and are therefore active mainly during the manufacturing process of the PDP, during the general heating steps to which the components of the display are subjected to favor outgassing or to seal the two (front and rear) glass panels. Conversely, moisture sorbing materials work better at room temperature, and in the case of calcium oxide, at the temperatures occurring during the manufacturing process of the PDP water could even be released. Consequently, NEGs are more useful for the removal of the impurities during the manufacturing of the PDP, while moisture sorbers are more useful during the service life thereof. Considering that the two types of material are complementary, it is also possible according to the process of the invention to foresee the formation of alternating deposits of moisture sorbing material and NEG. FIG. 9 shows this alternative possibility in a view similar to that of FIG. 8. In display 90, the deposits of a moisture sorbing material, 91, 91', . . . , are alternated to deposits of a NEG material, 92, 92', . . . . In this way, every channel (or cell) of the PDP is exposed to a surface of both materials, so that the NEG contributes to keeping the internal atmosphere of that channel (or cell) clean during the manufacturing of the PDP, while sorbing water possibly released from the moisture sorber during this step, whereas the moisture sorber performs the function of removing the water from each channel (or cell) during the service life of the PDP. To obtain this configuration it can be sufficient to manufacture the deposits of the two different materials, e.g. by sputtering, in two subsequent deposition phases, taking care to move the mask 60 between the two phases by a step as large as the distance between two contiguous ribs.

In any case it can be preferable to operate in such a way to produce getter deposits which are not too compact, because the presence of porosities in these deposits increases the surface of material in contact with the gases and as a consequence increases the sorption properties, particularly the speed. One way of producing NEG deposits by sputtering, which are particularly effective for the sorption of gases, is described in the European patent application publication EP 1518599 A2 in the name of SAES Getters S.p.A.

Preferably, the getter deposits, either of oxides of alkaline-earth metals or of NEG materials, are produced with the same technique with which the MgO layer of the front glass panel is produced, in order to limit the number of transfers to different process chambers, which are generally laborious and affect the cost of the whole process.

In a further variant, it is possible to add titanium dioxide, $TiO_2$, to the getter materials. It is in fact known that this material, when irradiated with UV radiation, is able to catalytically convert hydrocarbons into simpler species, and in the presence of oxygenated gases to water and $CO_2$. Due to the low efficiency of hydrocarbon sorption by the getter materials, the addition of $TiO_2$ in a plasma display panel (which internally produces UV radiation during its operation) allows the conversion these species into others which are more efficiently sorbed. In the case of deposits of moisture sorbing material, formed for example by screen-printing, it is possible to add $TiO_2$ particles to the initial suspension. In other cases, a $TiO_2$ deposit is preferably added on the getter material deposit (so that in the finished display it is in contact with the ribs) or underneath the same (so that it is between the getter material and magnesium oxide).

With the process of the invention the introduction of getter material in a PDP occurs easily, because it allows loosening of the requirements regarding dimensions and localization of the deposits of such a material. In particular, the difficulties encountered with the process of U.S. Pat. No. 6,603,260 B1, in depositing the getter onto the ribs with precise alignment and dimensioning, are avoided. These advantages are particularly appreciable when PDPs must be produced with complex shapes of the ribs, as in the case illustrated in FIG. 4.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A process for manufacturing a plasma display panel (80; 90) comprising the following steps:

manufacturing a front glass panel (FP) of a plasma display panel comprising pairs of supporting electrodes (E1) and scanning electrodes (E2), a layer of dielectric material (DF) for protection of the electrodes and a layer (M) of magnesium oxide covering the layer of dielectric material;

manufacturing a rear glass panel (RP) of a plasma display panel comprising barriers (R) defining channels (C) or cells in a finished display, address electrodes (AE) and phosphors (PR; PG; PB);

forming getter material deposits (63, 63', . . . ; 72, 72', . . . ; 81, 81', . . . ; 91, 91', . . . , 92, 92', . . . ) on a free surface of the magnesium oxide layer at positions which will essentially correspond to contact areas between the front glass panel and the barriers on the rear glass panel when the panels are placed together; and subsequently placing the front and rear glass panels together and sealing along the outer perimeter of the front and rear glass panels, thus defining a closed space or a plurality of closed spaces inside the display panel.

2. The process according to claim 1, wherein the deposits are formed in recesses (71, 71', . . . ) of the magnesium oxide layer.

3. The process according to claim 1, further comprising, after the sealing step and before filling the display panel with a rare gas mixture, evacuating the closed space or spaces inside the display panel by pumping through a tubulation connected to an opening in one of the glass panels, and sealing the display panel by compressing the tubulation under heat.

4. The process according to claim 1, wherein the sealing step is carried out in a chamber containing an atmosphere corresponding to a rare gas mixture required for operation of the display panel, and the sealing occurs simultaneously with a step of filling the display panel with the rare gas mixture.

5. The process according to claim 1, wherein the step of forming the getter deposits on the free surface of the magnesium oxide layer is carried out by a technique selected among screen-printing, sputtering, chemical vapor deposition and electron beam evaporation.

6. The process according to claim 5, further comprising, when the technique selected is screen-printing, consolidating the formed deposits by a thermal treatment.

7. The process according to claim 1, wherein the getter material comprises a moisture sorbing material.

8. The process according to claim 7, wherein the moisture sorbing material is selected from the group consisting of oxides of calcium, strontium and barium, mixtures thereof, and mixtures thereof with magnesium oxide.

9. The process according to claim 1, wherein the getter material comprises a non-evaporable getter material.

10. The process according to claim 9, wherein the non-evaporable getter material is selected from the group consisting of titanium, zirconium and alloys thereof with at least one element selected among the transition metals and aluminum.

11. The process according to claim 1, wherein the getter material deposits formed on the magnesium oxide layer comprise alternating deposits of moisture sorbing material (91, 91', . . . ) and deposits of non-evaporable getter material (92, 92', . . . ).

12. The process according to claim 1, wherein the step of forming the getter material deposits comprises forming a mask (60) having apertures (61, 61', . . . ) matching in shape and position those of the deposits to be formed, and arranging the mask in contact with or in proximity to the free surface of the magnesium oxide layer during the step of forming the deposits.

13. The process according to claim 11, wherein the alternating deposits are obtained in two successive deposition phases by a mask (60), and by moving the mask between the two deposition phases in a direction perpendicular to the barriers by a distance corresponding to the distance between two contiguous barriers.

14. A plasma display panel (80) obtained according the process of claim 1.

15. A plasma display panel (90) obtained according the process of claim 11.

16. The plasma display panel according to claim 14, containing also titanium dioxide in a form of particles mixed with particles of the getter material or in a form of deposits in contact with the getter material deposits.

17. A process for manufacturing a plasma display panel (80; 90) comprising the following steps:

manufacturing a front glass panel (FP) of a plasma display panel comprising pairs of supporting electrodes (E1) and scanning electrodes (E2), a layer of dielectric material (DF) for protection of the electrodes and a layer (M) of magnesium oxide covering the layer of dielectric material;

manufacturing a rear glass panel (RP) of a plasma display panel comprising barriers (R) defining channels (C) or cells in a finished display, address electrodes (AE) and phosphors (PR; PG; PB);

forming getter material deposits (63, 63', . . . ; 72, 72', . . . ; 81, 81', . . . ; 91, 91', . . . ; 92, 92', . . . ) on a free surface of the magnesium oxide layer at positions which will essentially correspond to contact areas between the front glass panel and the barriers on the rear glass panel; and subsequently contacting the getter material deposits with the barriers (R) and sealing along the outer perimeter of the front and rear glass panels, thus defining a closed space or a plurality of closed spaces inside the display panel.

* * * * *